United States Patent [19]

Holz

[11] Patent Number: 4,771,664

[45] Date of Patent: Sep. 20, 1988

[54] APPARATUS FOR THE CUTTING OF FOODS

[75] Inventor: Ernst Holz, Heidenheim, Fed. Rep. of Germany

[73] Assignee: holac Maschinenbau GmbH, Fed. Rep. of Germany

[21] Appl. No.: 937,338

[22] Filed: Dec. 3, 1986

[30] Foreign Application Priority Data

Dec. 18, 1985 [DE] Fed. Rep. of Germany ..... 3544807

[51] Int. Cl.[4] ..... B26D 3/20

[52] U.S. Cl. ..... 83/355; 83/408; 83/423; 83/467 R; 83/698; 83/751; 83/857

[58] Field of Search ..... 83/856–858, 83/408, 355, 356.3, 356.2, 698, 700, 402, 404, 404.1, 404.3, 751, 423, 467 R

[56] References Cited

U.S. PATENT DOCUMENTS

| | | | |
|---|---|---|---|
| 682,722 | 9/1901 | Lindenberg et al. | 83/751 X |
| 692,594 | 2/1902 | Ballbach | 83/751 |
| 2,327,018 | 8/1943 | Criner | 83/751 |
| 3,463,211 | 8/1969 | Holz | 83/404.3 |
| 3,614,970 | 10/1971 | Webb et al. | 83/408 |
| 4,051,757 | 10/1977 | Reifenhäuser et al. | 83/408 X |
| 4,372,184 | 2/1983 | Fisher et al. | 83/857 X |

*Primary Examiner*—Frank T. Yost

*Attorney, Agent, or Firm*—Welsh & Katz, Ltd.

[57] ABSTRACT

An apparatus for cutting foodstuffs, such as meat, and particularly bacon and sausage, is disclosed. The apparatus includes a carrying body from which holding flanges extend forwardly. Front and rear guide frames are supported in the holding flanges. Lattice knives move perpendicularly to one another and to the feed direction of the material to be cut. The guide frames are secured by a clamping mechanism which is supported on the carrying body and each have complimentary oblique side surfaces. The complimentary oblique side surfaces of the guide frames may be tightly clamped together so as to seal the spaces between the guide frames and the carrying body and thereby prevent the escape of the meat being cut.

13 Claims, 3 Drawing Sheets

APPARATUS FOR THE CUTTING OF FOODS

BACKGROUND OF THE INVENTION

The present invention relates to an apparatus for cutting food, such as meat, and more particularly bacon and sausage. The apparatus comprises a frame having forwardly extending holding flanges. Front and rear guides, supported by the frame in turn, support an array of lattice knives which are both movable in the guide frames perpendicularly to one another and to the feed direction of the material to be cut.

German Pat. No. 29 23 003 teaches a food cutting machine having a first guide secured to a holding frame. The holding frame is connected to the cutting machine by means of a second guide, which may be locked to the holding frame. The second guide has a lug engaged in a groove on one side on the inside of the holding frame. On the Opposite side the second guide has a pin slidable in place transversely to the feed direction. The pin passes through the holding frame and the first guide frame. A disadvantage of the device of German Pat. No. 29 23 003 is that the guide frames are not clamped together under pressure. As a result the material to be cut can escape through gaps between the individual parts, particularly between the first and the second guide. The residue of the material to be cut and other dirt can collect in these gaps and can be a breeding ground for unwanted bacteria and other disease carrying organisms. For this reason the apparatus of German Pat. No. 29 23 003 must be frequently cleaned.

German unexamined patent specification No. OS 29 40 090 teaches an apparatus for food cutting having two guide frames pressed together against a fixed part of the machine by a clamping bolt. The clamping bolt is part of an eccentric clamping arrangement in which plate springs provide the contact pressure force. Such a clamping arrangement can be relatively expensive. The elasticity of the plate springs permits relative movement between the two guide frames. In addition, if the pressure forcing the material through the knives is greater than the spring pressure clamping the guide frames together, the material escapes laterally. Furthermore, clamping with the four bolts described in No. OS 29 40 090 can be time consuming, which, because the lattice knives must be frequently clamped, becomes very inefficient.

Therefore, an object of the subject invention is an apparatus in which the individual parts of the cutting apparatus can in a simple and rapid manner be clamped securely so that material to be cut cannot escape, laterally or otherwise, between the individual parts.

SUMMARY OF THE INVENTION

The aforesaid problems are solved by an apparatus for the cuttng of foods, such as meat, and particularly bacon and sausage, and includes a frame having flanges extending forwardly, with a front and rear guide disposed therein. An array of lattice knives are movable in the guides both perpendicularly to one another and to the feed direction of the material to be cut. The front guide has at least one wedge-shaped oblique surface on its side. Positioned over the front guide and supported on the flanges is a clamping frame having on the side facing the front guide frame, wedge-shaped oblique surfaces complementary to the oblique surfaces on the front guide frame. An oblique surface can also be provided in the middle zone of each side of the clamping frame.

When the clamping frame is compressed against the front guide frame, the oblique surfaces of the clamping frame cooperate with the corresponding oblique surfaces on the front guide frame. As a result, a simple and rapid clamping and a faultless seal between the first and the second guide frame is achieved. In this manner, simply by tightly clamping the clamping frame, lateral escape of the material to be cut, which could lead to fouling and thus to a cleanliness problem, is prevented. Simultaneously, by reason of the two oblique surfaces, the front guide frame is pressed to the rear against the rear guide frame and the rear guide frame in turn is pressed onto the carrying body or another fixed part of the apparatus.

In order to prevent canting or tilting of the guide frames, each of the opposing sides of the clamping frame can have two, rather than one, spaced oblique surfaces. When sliding in the clamping frame of this embodiment, the first oblique surface of the clamping frame must pass the first oblique surface of the guide frame. Thus these oblique surfaces can lie, for example, laterally offset fron one another.

In another embodiment of the subject invention, the clamping frame has two lateral spars each having an oblique surface, the two spars being joined by an upper yoke and held with their free ends in recesses of the holding flanges.

The wedge-shaped oblique surfaces of the present invention are constructed in such a way that they are self-inhibiting, i.e., they lock to prevent undesired movement. To improve safety, however, the clamping frame, to prevent loosening, can use a variety of locking devices. For example, a locking member can press the clamping frame against the front guide frame, the clamping member being supported on the carrying body or another fixed part.

Alternatively, the clamping member can carry at least one clamping screw which is screwed into a threaded bore of a tension strip arranged over the upper yoke of the clamping frame. Thus the screw bias against the yoke to hold the tension strip in place in a recess of the carrying body to provide a simple, yet effective security arrangement. If only one clamping screw is used, it is positioned in the central zone of the device. However, in order to avoid tilting movement and for a more uniform float, two clamping screws are spaced from one another. This system biases the yoke of the clamping frame and the clamping frame toward the front guide frame, thereby securing the wedging action of the clamping frame.

Other security arrangements can also be used within the scope of the invention, taking care only that the securing of the clamping frame be as simple and rapid as possible. For example, an eccentric security device or a toggle lever tensioning device in which a part of the device is supported on the carrying body or another fixed part of the device can be used. The movable part of the device presses the clamping frame towards the guide frame in such a manner that will wedge the frames together.

The use of a clamping frame provides a further advantage. In order to cut meat into cube form, generally a turntable separating knive is placed in front of the lattice knives which cut the meat into strip form. The separating knife then cuts the meat into cube form. However, when cutting meat, especially sinuous meat, the individual pieces somtimes remain connected by single fibers. In addition, the separating knives can displace the material with the knife pressure. This is especially true for the strips to be cut last during the cutting process. For this reason a counter-holder for supporting the meat is generally placed in front of the knives.

In counter-holders of the prior art, the counter-holder was fastened to a fixed part of the carrying body, and in order to change the lattice frame, which can occur relatively frequently, the counterholder had to be separately disassembled each time.

In the present invention the counter-holder is fastened to the clamping frame, generally its front side of the spar. As a result when the lattice knives are changed, simultaneously with the removal of the clamping frame, the counter-holder is also removed, eliminating a time-consuming step.

In the following an example of one embodiment of the invention is shown with reference to the drawings.

DETAILED DESCRIPTION OF THE PREFERRED EMBODIMENT

Figure 2:
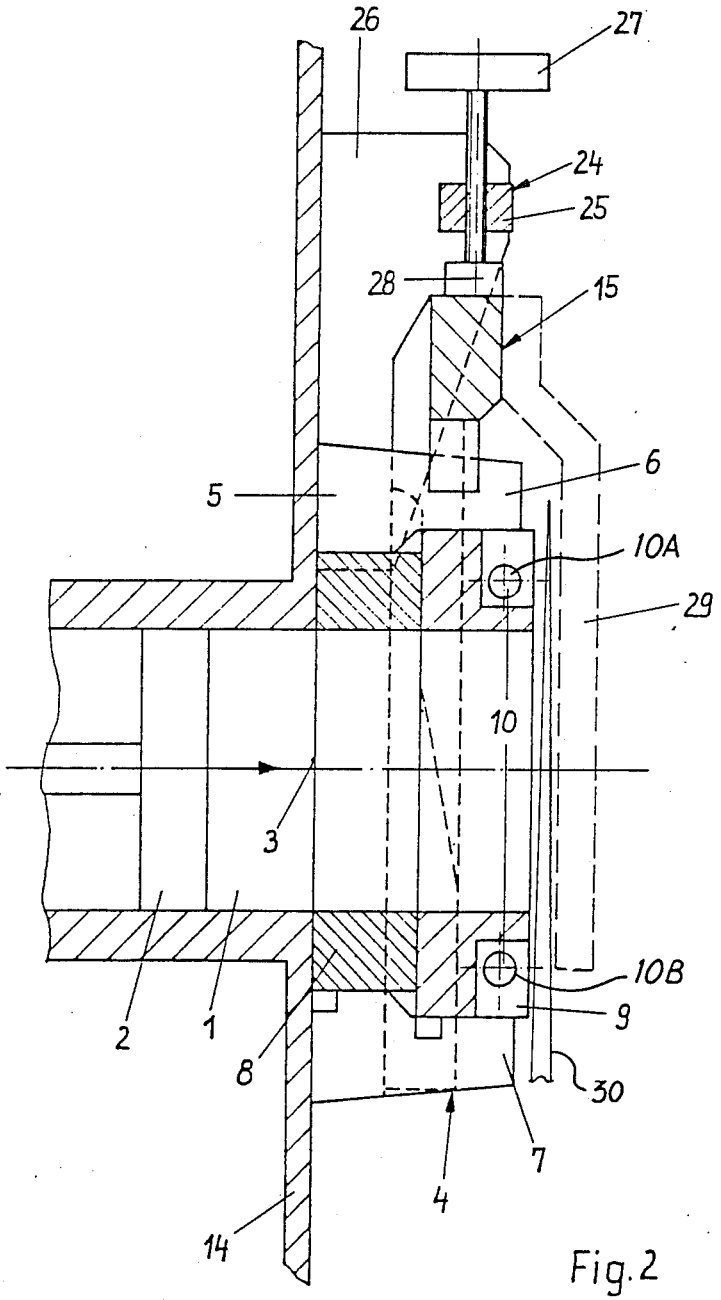
FIG. 2 is a sectional view taken along line II—II of FIG. 1.

As shown in FIG. 2, food stuffs such as meat are fed into a tubular shaft 1, and a feed stamp 2 presses the meat through opening 3 into lattice block 4. The lattice block 4 has a carrying body 5, from which holding flanges 6 and 7 laterally and forwardly extend on the upper and lower side respectively. The holding flanges 6 and 7 serve as guides for a first or rear guide frame 8 and a second or front guide frame 9 respectively. The carrying body 5, from which the holding flanges 6 and 7 extend, is fastened in any generally known manner as by screws, to a fixed part 14 of the apparatus.

Figure 1:
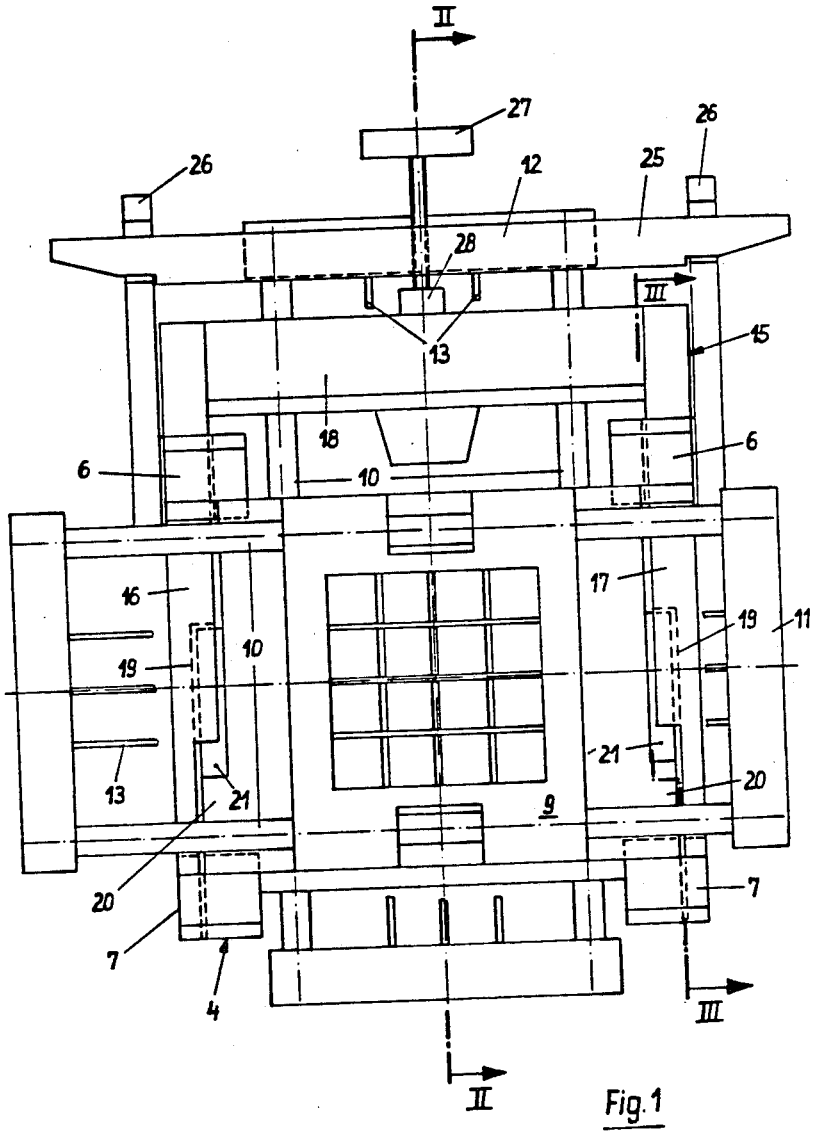
FIG. 1 shows a front elevational view of the apparatus for cutting foods of the present invention.

The two guide frames 8 and 9 are provided with bores 10A and 10B, which run horizontally in guide frame 9 and vertically in guide frame 8. Through these bores guide rods 10 are inserted. The two guide rods 10 form a part of knife lattices 11 and 12, respectively, in which several knives 13 are arranged both horizontally and vertically. In FIG. 1, for reasons of simplicity, only a few of the knives are represented. Knife lattices 11 and 12 may be moved to form a grid-like structure, to cut the food into strip form. The knife lattices 11 and 12 may each be moved back and forth horizontally and vertically, respectively.

Figure 3:
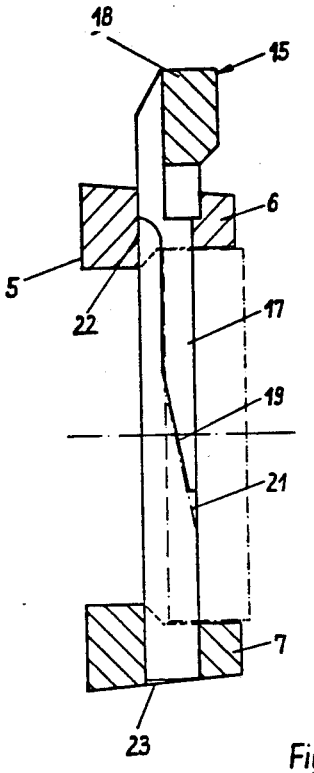
FIG. 3 is a sectional view taken along line III—III of FIG. 1.

A clamping frame 15 clamps the guide frames 8 and 9 securely to the carrying body 4, and thereby to the fixed part 14 of the apparatus. As shown in FIG. 1, the clamping frame 15 includes two lateral spars 16 and 17 which are vertically disposed and connected with one another on their upper ends by yoke 18. Oblique surfaces 19 are located on the inside of the two spars 16 and 17, i.e., on the side facing the center of the apparatus proximate their mid-section. The front guide frame 9 has lateral extensions 20 on both sides, each having an oblique surface 21. The oblique surfaces 21 and 19 are complementary to and thus mate with one another. As is evident from FIG. 3, the clamping frame 15 is thrust from above into recesses 22 and 23 in the holding flanges 6 and 7. When proximate one another the two oblique surfaces 19 encounter the oblique surfaces 21 in complementary fashion in the front guide frame 9. Upon application of further downward pressure the front guide frame 9 is biased or wedged against the rear guide frame 8 and the rear guide frame 8 is biased or wedged against the carrying body 5 or the fixed part 14 of the apparatus. By this wedging effect a sure and faultless seal is achieved between guide frames 8 and 9 and the carrying body 5 without any lateral gaps. Nor do gaps occur during the cutting operation through which the meat can escape.

In order to detach the front and rear guide frames 8 and 9, the clamping frame 15, is loosened, if the guide frames 8 and 9 and the lattice knives 11 and 12 can be changed.

As shown in FIG. 2, as a safeguard against inadvertent loosening, a security mechanism 24 can additionally be provided to assure that the clamping frame 15 cannot be inadvertently thrust upward. In one embodiment, a tension strip 25 lies in recesses in two lateral flanges 26 of the carrying body 5. The tension strip 25 has in its middle zone, i.e., in the vertical middle plane of the apparatus, a threaded bore with one or more clamping screws 27. The free end of the clamping screw 27 bias against a tensioning block 28 resting on yoke 18 of the clamping frame 15. If need be, tensioning block 28 can be omitted.

To secure the clamping frame 15 in a wedged position the clamping screw 27 is twisted clockwise. The tension block 28 is biased against the clamping frame 15 while the tensioning strip 25 is supported in the recesses in the flanges 26.

Figure 4:
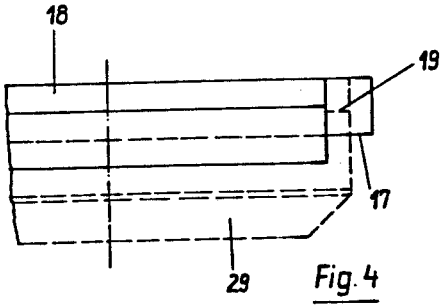
FIG. 4 is a top plan view of the apparatus for cutting foods of FIG. 1, showing in particular a clamping device of one embodiment of the subject invention.

On the front side of the clamping frame 15 a counter-holder 29 (represented in broken lines in FIGS. 2 and 4 and not shown in FIG. 1) is fastened to the clamping frame 15 in any known manner, as by screws. A generally sickel-shaped severing knife 30 is located in the gap between the front guide frame 9 and the counter-holder 29 and cuts the strips of food coming from the two lattice knives 11 and 12 into cube form by rotating in front of the front guide frame 9. Generally, the last pieces of meat to be cut will tend to evade cutting. Placing the counter-holder 29 in front of the knives to support the strips of meat provides for more efficient and effective cutting. In the embodiment represented, the severing knife passes from the left in front of the guide frame 9. As a result the meat is cut off beginning from left to right.

While the invention has been described with reference to a preferred embodiment, it will be reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An apparatus for the cutting of foods, comprising:

a carrying body having holding flanges extending forwardly therefrom;

front and rear guide frames disposed in said holding flanges;

lattice knives disposed in said front and rear guide frames, said lattice knives being movable perpendicularly relative to one another;

said front guide frame having two laterally disposed sides; at least one of said sides having an oblique surface; and a clamping frame disposed over said front guide frame said clamping frame having oblique surfaces complementary to said oblique surfaces on said front guide frame.

2. The apparatus according to claim 1, characterized in that said oblique surfaces are in the middle portion of said guide frames and said clamping frame.

3. The apparatus according to claim 1, characterized in that on each of said laterally disposed sides of said guide frames is an oblique surface said oblique surfaces being complementary to said oblique surfaces on said clamping frame.

4. The apparatus according to claim 1, characterized in that said clamping frame comprises two lateral spars each having an oblique surface, said spars being joined by a yoke, said spars each extending into and engaged in recesses in said holding flanges.

5. The apparatus according to claim 1, characterized in that said clamping frame includes means for securing said clamping frame.

6. The apparatus according to claim 5, characterized in that said means for securing includes a tensioning member for biasing said clamping frame against said front guide frame.

7. The apparatus according to claim 4, and further comprising at least one clamping screw and a tension strip, said clamping screw being screwed into a threaded bore in said tension strip, said tension strip being arranged over said yoke of said clamping frame, said clamping screw pressing on said yoke so as to secure said clamping frame.

8. The apparatus according to claim 1, characterized in that a turnable separating knife is disposed in front of said clamping frame for cutting off strips of meat and a counter-holder attached to said clamping frame for supporting the last pieces of the meat, said counter-holder being removable with said clamping frame, thereby facilitating cleaning and disassembly of said apparatus.

9. The apparatus according to claim 8, characterized in that said counter-holder is fastened to the front side of one of said spars.

10. An apparatus for the cutting of foods comprising:

a lattice block having an opening therethrough;

a food stamp for pressing food through said opening;

a plurality of movable guide frames slidably connected to said lattice block;

a plurality of lattice knives movably positionable in a grid pattern between said guide frames and said lattice block;

means for fixedly clamping said guide frames once positioned on said lattice block and or sealing said guide frames relative to each other and said lattice block so as to prevent the passage of food between said guide frames and said lattice block, said clamping means comprising at least one oblique surface on each of said guide frames; and a clamping frame attached to said lattice block, said clamping frame having movable portions facing said guide frames, said movable portions of said clamping frame having oblique surfaces complementary to said oblique surfaces of said guide frames and planar surfaces complementary to and adapted for abutment against said guide frames whereby said movable portions of said clamping frame may be wedged against said guide frames so as to move said guide frames together and to fixedly position one of said guide frames to said lattice block and said clamping frames to said guide frames so as to seal the spaced between said guide frames and said lattice block.

11. The apparatus according to claim 10, characterized in that said clamping frame includes means for securing said clamping frame.

12. The apparatus according to claim 11, characterized in that said means for securing includes a tensioning member that presses said clamping frame against said front guide frame.

13. The apparatus according to claim 12, characterized in that said tensioning member includes at least one clamping screw and a tension strip, said clamping screw being screwed into a threaded bore in said tension strip, said tension strip being arranged over an upper yoke of said clamping frame, said clamping screw pressing on said yoke so as to secure said clamping frame.

* * * * *